US005339721A

United States Patent [19]

Beretta

[11] Patent Number: 5,339,721

[45] Date of Patent: Aug. 23, 1994

[54] TRIPPING MECHANISM FOR SEMIAUTOMATIC AND AUTOMATIC FIREARMS

[75] Inventor: Pier G. Beretta, Gardone V.T., Italy

[73] Assignee: Fabrica d'Armi P. Beretta S.p.A., Gardone V.T., Italy

[21] Appl. No.: 980,577

[22] Filed: Nov. 23, 1992

[30] Foreign Application Priority Data

Jan. 14, 1992 [IT] Italy ..... BS92 A 000001

[51] Int. Cl.[5] ..... F41A 19/46

[52] U.S. Cl. ..... 89/142; 89/149

[58] Field of Search ..... 42/69.03, 70.06; 89/140, 141, 142, 149, 151, 154

[56] References Cited

U.S. PATENT DOCUMENTS

| | | | |
|---|---|---|---|
| 1,004,424 | 9/1911 | Hennick | 89/154 |
| 2,780,145 | 2/1957 | Saive | 89/151 |
| 3,015,993 | 1/1962 | Franchi | 89/140 |
| 3,029,708 | 4/1962 | Marchisio | 89/142 |

*Primary Examiner*—Stephen C. Bentley
*Attorney, Agent, or Firm*—McGlew and Tuttle

[57] ABSTRACT

The invention relates to a tripping mechanism for semiautomatic and automatic firearms with a closed-type bolt carriage and which can be used in either a single shot firing mode or an automatic firing mode. The mechanism has a sear 4 slidably fitted on the trigger between the oscillating pivot 5 of the trigger and a resting plane 6*a* formed on the trigger, away from the pivot. The sear is stressed by a spring 11 which normally pushes it towards the hammer to interact with the latter. The sear 4 is susceptible to movement with the trigger when the trigger is operated and is also susceptible to a longitudinal sliding on the trigger in one direction due to spring 11 and in the opposite direction due to the hammer at least during the engaging in armed position phase, as well as the balancing phase between oscillating pivot 5 and resting plane 6*a*.

7 Claims, 7 Drawing Sheets

TRIPPING MECHANISM FOR SEMIAUTOMATIC AND AUTOMATIC FIREARMS

FIELD OF THE INVENTION

The present invention relates to semiautomatic and automatic firearms with a closed-type bolt carriage and more particularly with regards to a tripping mechanism for such firearms, especially machine guns.

SUMMARY AND OBJECTS OF THE INVENTION

An object of the present invention is to supply a tripping mechanism for firearms with a new conception and execution and which permits the firearm to be used both in a single shot firing mode and in an automatic, continuous firing mode, by changing over the mechanism from one condition to the other through a selector cam rod which also acts as a safety rod and with the help of a lever placed on the side of the hammer which is designed to delay the percussion action of the hammer in order to ensure the closure of the obturator beforehand.

Another object of the invention is to supply a tripping mechanism of a simpler construction than the ones known so far, formed from a limited number of components and which is reliable due to this simplicity.

The here proposed tripping mechanism is fitted onto an underguard which is insertable in the trip box of a semiautomatic or automatic firearm with an open bolt. Next to the trip box is a bolt carriage which is movable between a forward position of closure/percussion and a backward position of aperture/arming. The bolt carriage defines a split and has a blocking plane surface. A portion of the blocking plane surface is beveled towards the split. A firing pin is positioned in the split. A pivotable hammer, pivots between a percussion position which is adjacent to firing pin and in armed position which is spaced away from the percussion position. When the bolt carriage moves towards the backward or aperture/arming position, the bolt carriage moves the hammer toward the backward position. When the bolt carriage moves towards and into a forward position, a hammer spring moves the hammer forward towards the percussion position. The hammer is shaped to be slidable into the split of the bolt carriage when the hammer pivots towards the percussion position and the bolt carriage is in the forward position.

A trigger is pivotably connected to the trip box by a trigger pivot and is pivotably movable between a rest position and a firing position. The trigger has a resting plane. A sear is slidably fitted between the trigger pivot and the resting plane. The sear is biased by a sear spring in a direction towards the hammer and is also movable with the trigger when the trigger is pivoted or operated. The sear has an engagement means for engaging with the hammer in the on position when in the single shot mode. The sear slides away from the hammer when the hammer moves into the on position and the sear also balances between the trigger pivot and the resting plane.

Further details of the invention will appear clearer following the description with references being made to the attached drawings regarding an embodiment for the release mechanism.

BRIEF DESCRIPTION OF THE DRAWINGS In the drawings.

DETAILED DESCRIPTION OF THE PREFERRED EMBODIMENT

Figure 1:
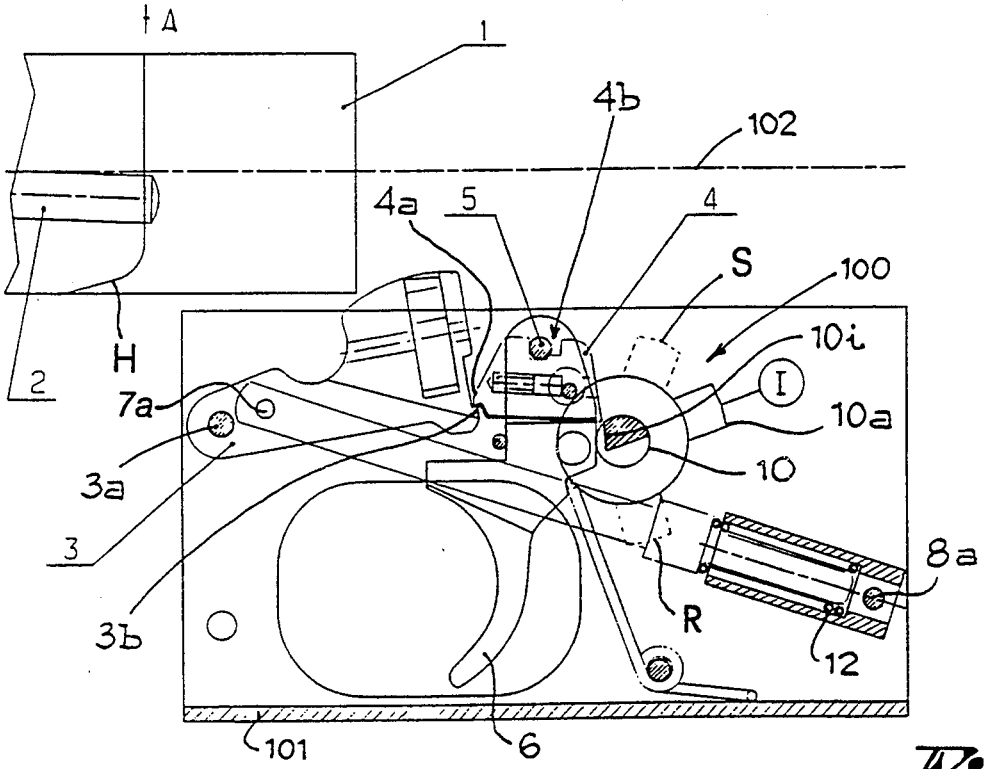
FIG. 1 shows the tripping mechanism in a "ready to fire" static situation and in relation to the bolt carriage of the firearm in a closed position.

The tripping mechanism 100 is fitted onto an underguard 101 which is insertable in the trip box (not shown) of a firearm such as a machine gun. The firearm has a barrel, of which only the axis 102 is indicated, and a bolt carriage 1 carrying a firing pin 2 only partially shown and already known. The bolt carriage 1 is movable in a known way from a forward position A of closure/percussion of ammunition in the barrel to a backward position B of aperture/arming and vice versa. In particular, it should be noted that the bolt carriage 1 has a sloped plane H on its lower part, at the level of the back end of the firing pin 2. The sloped plane H is angled frown the top to the bottom, from the back towards the front of tile bolt carriage itself and has a split **1*b* aligned to the firing pin 2** in its back part.

The tripping mechanism 100 comprises a percussion hammer 3, a sear 4, a trigger 6 and a safety camshaft.

The hammer 3 is fitted onto the underguard 101 through a rotating axle **3*a* for its angular movements towards and away from the firing pin 2** in the closure/- percussion B and aperture/arming A positions of the bolt carriage 1 respectively. The hammer 3 has an arming tooth 3*b* on its top which is designed to interact with a release tooth 4*a* integral to the sear 4 for the stopping of the hammer in its armed position. The hammer 3 is also stressed by a hammer spring 12 placed between a spring holder rod 7 and a spring guide housing 8 and is designed to move the hammer to its percussion position on the firing pin 2 when tile hammer 3 is released from the sear 4.

The spring holder rod 7 and the spring guide housing 8 are aligned and whilst the rod 7 is pivoted 7*a* to an intermediate part of the hammer 3, the spring guide housing 8 is pivoted 8*a* to the underguard 101 so that the two elements 7, 8 can vary their position depending on the position and rotation of the hammer.

The sear 4 is fitted as a slide which is susceptible to longitudinal movements on the trigger 6 and is normally pushed forwards towards the hammer 3 through a sear spring 11 placed between the sear itself and a pin 11*a* fixed to the underguard 101. The base of the sear 4 rests on a plane 6*a* which is formed on the trigger.

The trigger 6 is pendulum fitted on the underguard 101 through an oscillating trigger pivot 5 and is stressed by a spring 9. This spring normally tends to move and keep the trigger 6 in a forward inactive position, that is to say at rest, whilst it loads when the trigger is operated.

It should be noted that the oscillating pivot 5 of the trigger 6 is found in a split 4*b* formed on the top of the sear 4. This is so that the pivot can alternately interact with the sides of the split 4*b* in order to limit the longitudinal sliding of the sear and also to engage with a step 4*c* on the bottom of the split so as to determine a balancing of the sear following its longitudinal movements and to favor the engaging of the hammer in the armed position by the sear.

The safety camshaft 10 is transversely fitted in the underguard 101 behind the trigger 6. It can be rotated through a safety lever 10*a* and can be stopped in three different positions (with reference to the lever):

a safety position 'S';

a single sot firing position 'I';

an automatic firing position 'R'.

In the intermediate part of such a safety camshaft (FIG. 2) there is a portion with a cylindrical surface 10*s* and two flattenings or depressions 10*i*, 10*r* of different depths. By rotating the camshaft 10 in the above mentioned positions it is possible to turn the cylindrical surface portion 10*s* or one or the other of the two flat surfaces 10*i*, 10*r* towards the trigger in order to secure the firearm or to respectively choose whether to use the firearm for single shot firing mode or automatic firing mode. The flat surface 10*i*, 10*r* allow for a different backwards movement of the trigger when operated.

Finally an automatic firing lever 14 is fitted in a recessed position on the side of the hammer 3.

The lever 14 oscillates on an intermediate pivot 14*a* and has a head 14*b* designed to interact with the lower blocking plane G of the bolt carriage 1 and a tail 14*c* designed to rest against the hammer. An automatic firing spring 15 normally tends to move the lever 14 by the head 14*b* outwards, outside the profile of the hammer. The movement is delimited on the other side by the tail 14*c* which rests against the hammer. The lever is returned to the position inside the hammer profile because of a bevel 1*a* formed at the free end (back) of the bolt carriage, on one side with respect to the trajectory of the hammer, that is to say on one side of the split 1*b* of the bolt carriage.

FIG. 1 of the drawings show the tripping mechanism in a static "ready to fire" situation. Thus, the tooth 3*b* of the hammer 3 is engaged to the sear tooth 4*a* of the sear 4 in a cocked position; the bolt carriage is moved forwards in the closed position (A); the trigger 6 is at rest and the safety camshaft 10 is rotated in the single shot firing mode 'I'. In such conditions, the sear 4 is kept in a balanced position through its contact with the plane 6*a* of the trigger, by the resting of the front side and the bottom 4*c* of its split 4*b* against the oscillating pivot 5 of the trigger 6 and obviously, by the force exerted on it by the hammer through the coupled teeth 3*b*, 4*a*. The hammer 3 is thus ready to be released for the percussion action on the firing pin 2 which is on the bolt carriage 1.

Figure 2:
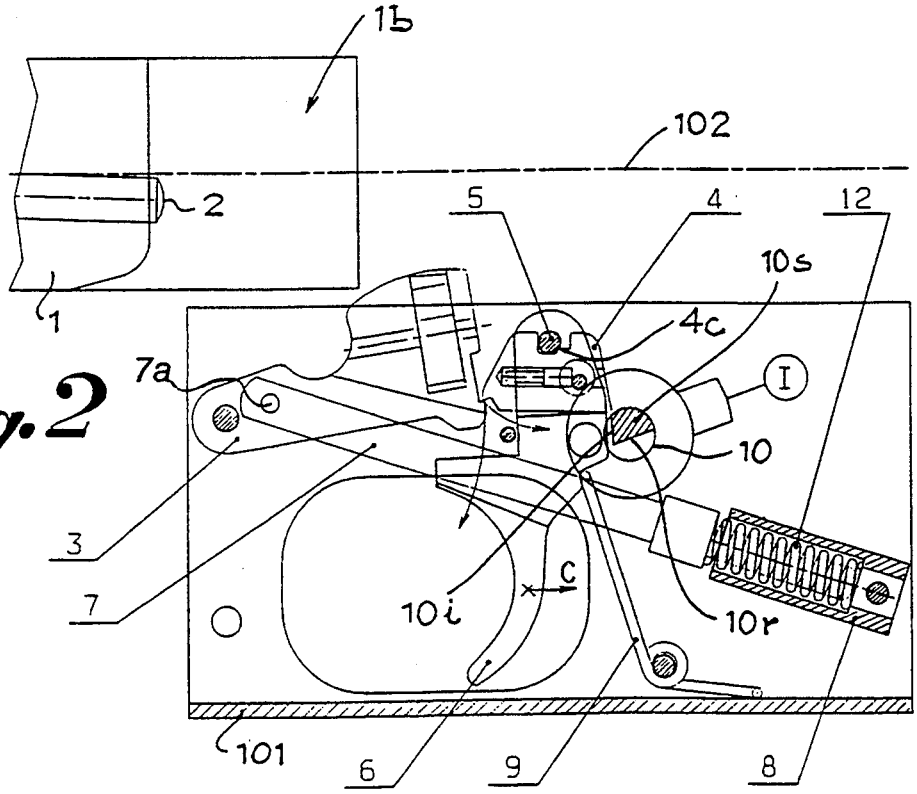
FIG. 2 is a similar view to the one in FIG. 1, but with the device in a position a moment before the releasing of the hammer in the single shot firing mode.
Figure 3:
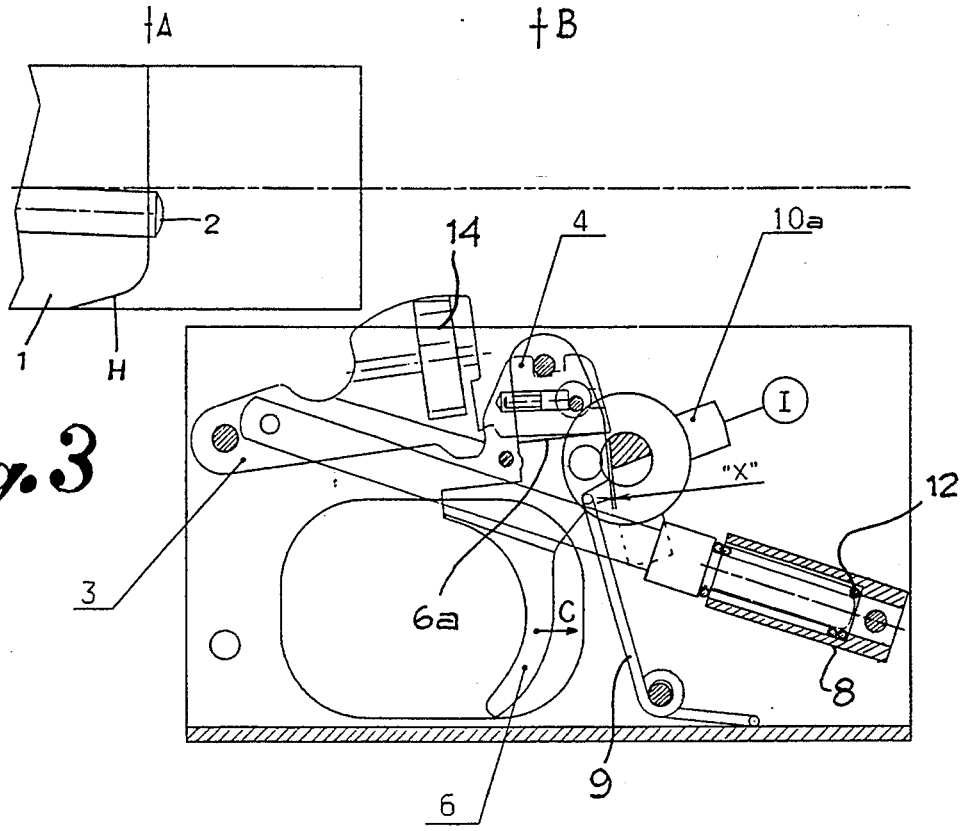
FIG. 3 is a view as in FIG. 2, but at the moment when the hammer is released.

Such a release of the hammer occurs by voluntarily operating the trigger 6 according to the arrow 'C' shown in FIGS. 2 and 3. When the trigger 6 is operated, it rotates on the pivot 5 and moves the sear 4; the hammer 3, which is engaged with the sear tooth 4*a*, slightly rotates downwards according to the arrows in FIG. 2. This rotation of the hammer 3 causes a further compression of the spring 12 whilst the rotation of the trigger 6 causes a further loading of the spring 9.

When the trigger 6 is pressed (FIG. 3) but is not yet engaged on the safety shaft, the sear 4 disengages the hammer 3. The spring 12 pushes the hammer 3 which rotates towards the bolt carriage 1. There still remains a space 'X' between the trigger 6 and the flat surface 10*i*, (single shot firing mode) of the safety camshaft 10.

Figure 4:
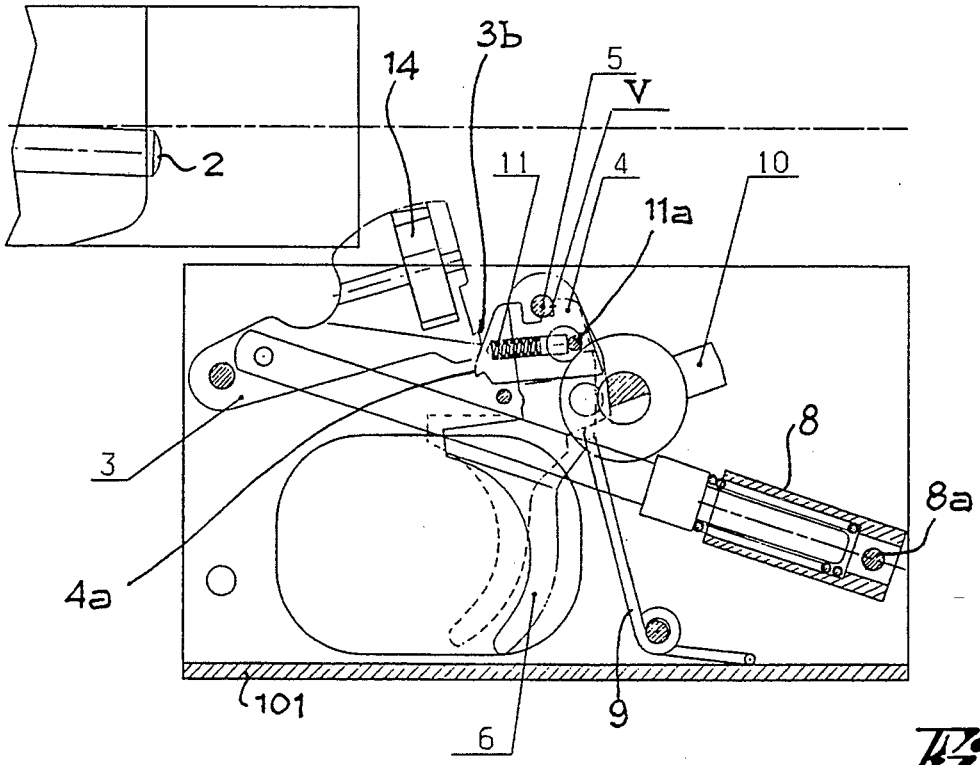
FIG. 4 shows the mechanism with the hammer as released and in an intermediate position of its movement towards the firing pin.

When the trigger is completely pressed it stops against the fiat surface 10*i*, (the least deep), whilst the rotating hammer slides against the sear 4, (FIG. 4), in its first movement phase and then abandons the sear in order to move towards the firing pin.

In this situation the sear is subject to:

- a forward translation towards the hammer because of the relative spring 11;
- a forward balancing as the pivot 5 of the trigger comes into contact with the step 4*c* on the bottom of the split of the sear;
- a stopping as the back side (V) of the split rests against the pivot 5.

Figure 5:
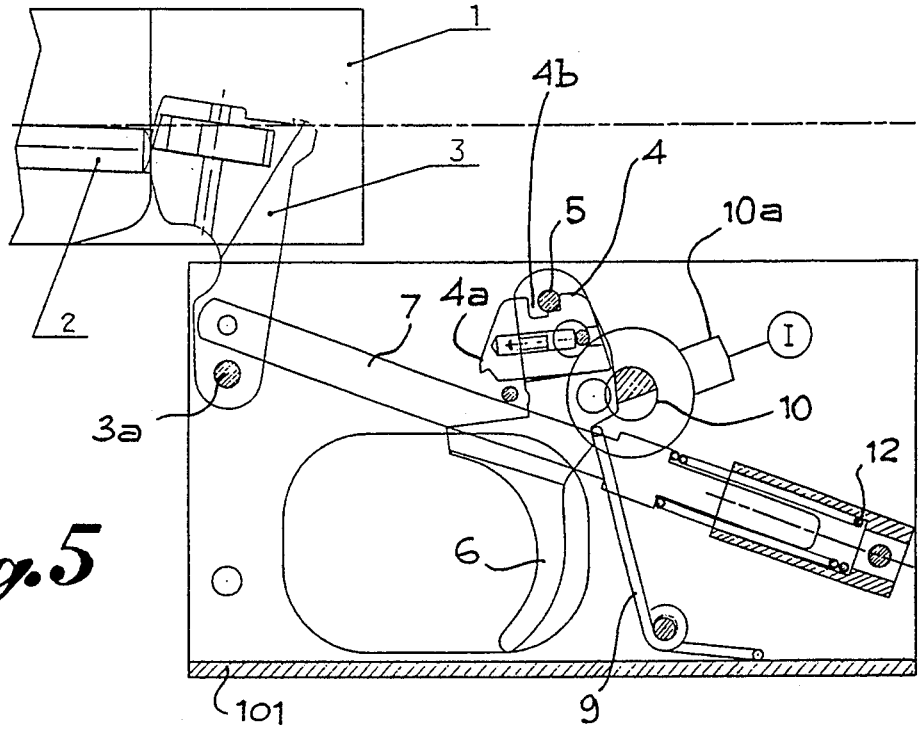
FIG. 5 shows the mechanism with the hammer in a position of percussion on the firing pin for the shooting of a round of ammunition.

FIG. 5 shows the mechanism with the hammer released in the percussion position on the firing pin 2 on the bolt carriage 1 for the firing of ammunition in the barrel; the trigger is always operated through voluntary pressure. The automatic firing mode lever 14 on the side of the hammer 3, in contact with the bevel 1*a* on the bolt 1 returns into the profile of the hammer.

Figure 6:
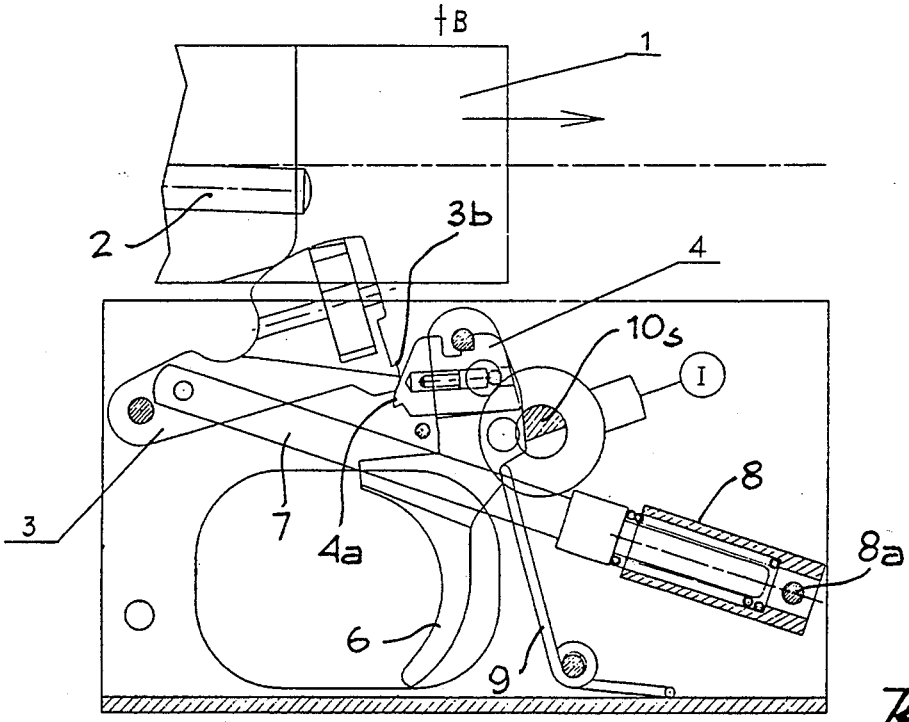
FIG. 6 shows the mechanism in an intermediate recocking phase of the bolt carriage which returns to the opening position after the shooting of each round of ammunition.
Figure 7:
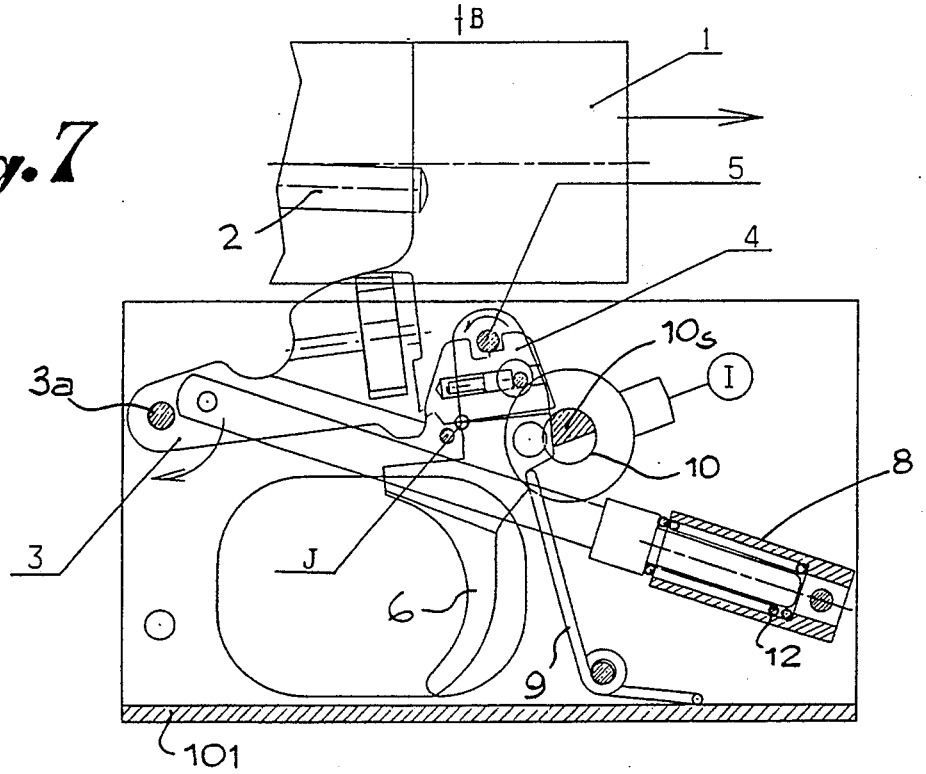
FIG. 7 shows the mechanism the moment before the engaging of the hammer by the sear.
Figure 8:
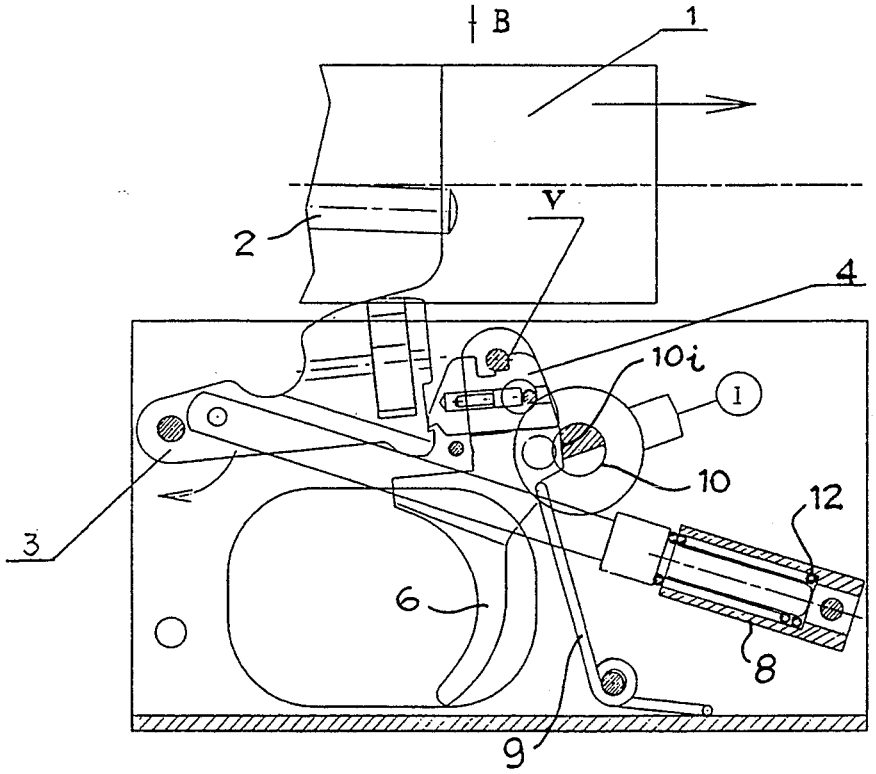
FIG. 8 shows the mechanism at the moment when the hammer engages to the sear and whilst the trigger is still pressed.

Following the firing of ammunition, the bolt carriage moves backwards towards the opening position B causing the rotation of the hammer towards the sear 4 through the sloped plane H. FIGS. 6, 7 and 8 show the cocking sequence of the hammer. In FIG. 6 the hammer comes into contact with the sear pushing it back in opposition to the action of the spring 11. When pushed by the hammer (FIG. 7), the sear 4 makes composite movements, firstly rotating forwards (anti-clockwise in FIG. 7) with respect to the pivot of the trigger and then translating towards the back. These movements are forced from the top by the pivot 5 resting on the step 4*c* and from the bottom by the sear resting J on the plane 6*a* of the trigger. The seal, 4 is then in an unstable position which resets as soon as the tooth 3*b* of the hammer goes under the tooth 4*a* of the sear 4, (FIG. 8). In this condition the sear 4 translates forwards when pushed by the spring 11 until it rests V against tile pivot of the trigger and into the engaging position of the hammer as soon as the bolt carriage, which has finished the contrary stroke, returns forwards in the closed position (FIG. 1). The firing of another single shot will then only be possible by releasing the trigger and then pressing it once more.

For the automatic firing mode, it is first of all necessary to rotate the safety camshaft 10 into the 'R ' position where the automatic firing flat surface 10r, which is the deepest, is turned towards the trigger.

The firing of a first shot and the releasing sequence of the hammer from the sear take place in a similar way as described in relation to FIGS. 1–4.

Figure 9:
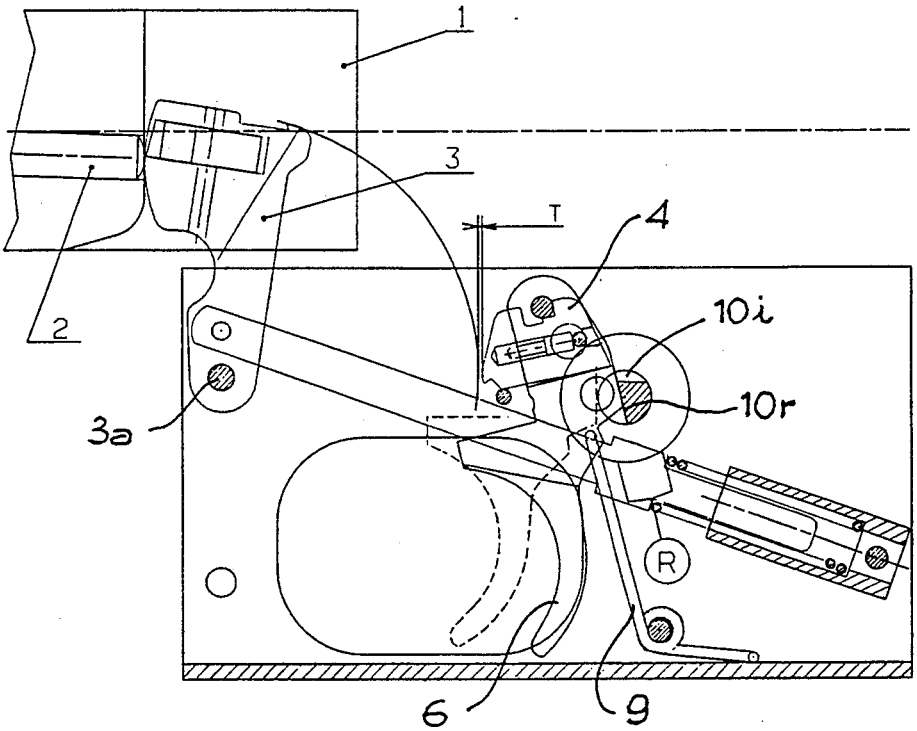
FIG. 9 shows the mechanism with the hammer in a percussion position as in FIG. 5, but in an automatic firing mode.

FIG. 9 shows the mechanism for an automatic firing mode where the operated trigger 6 is moved against the automatic firing flat surface 10*r* of the safety camshaft 10 and where the hammer 3 is in a percussion position on the firing pin 2 of the bolt carriage 1, obviously in the closed position A. When the trigger 6 rests against the flat surface 10*r* the sear 4 never intercepts the hammer 3 because it is at a 'T ' distance out of the trajectory of the hammer. The hammer thus rotates backwards when pushed by the bolt carriage which returns to the open position B and then forwards towards the firing pin when the bolt carriage goes in the closed position A for firing a second shot, a third shot, etc. in sequence as long as the trigger is pressed.

Figure 11:
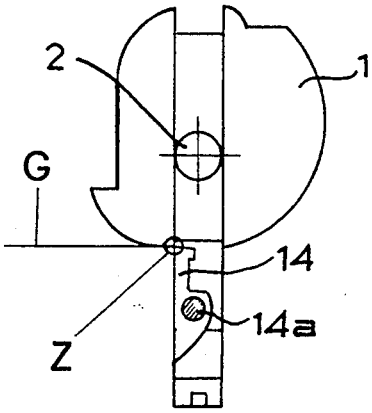
FIG. 11 is a view of the bolt carriage and of the hammer in direction of the arrows XI–XI in FIG. 10.
Figure 10:
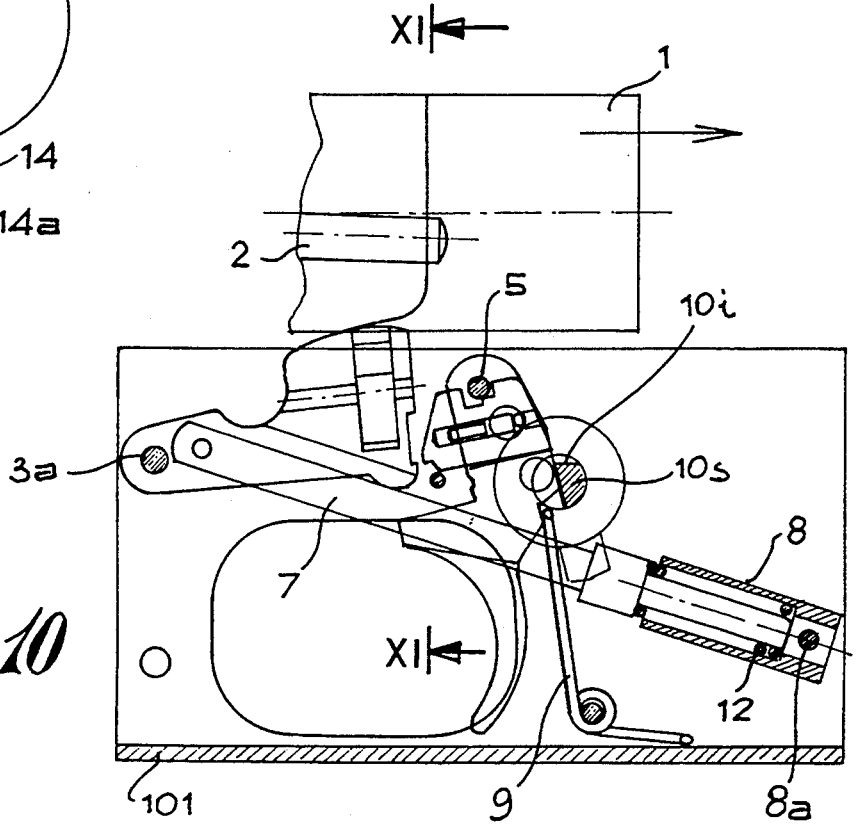
FIG. 10 shows the mechanism in the automatic firing mode at the moment of the releasing of the automatic firing lever with the bolt carriage in a backing phase.
Figure 12:
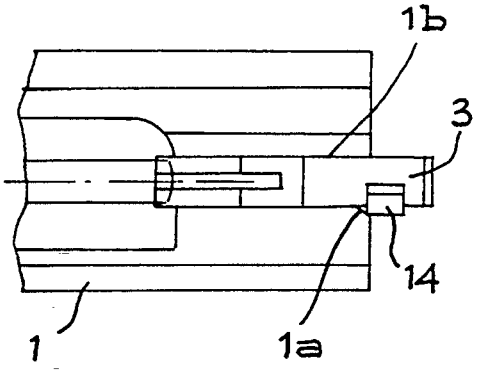
FIG. 12 is a view from above of the bolt carriage and of the hammer.
Figure 13:
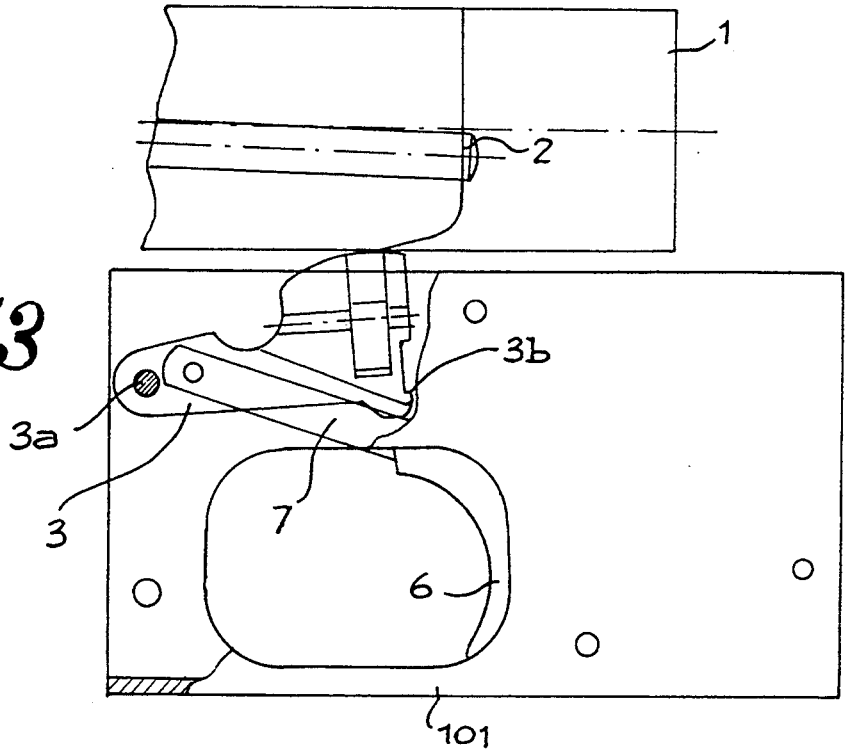
FIG. 13 is a similar view to the one in FIG. 10, but with the bolt carriage completely backwards.

FIG. 10 shows the mechanism once again in the automatic firing mode and during the phase in which the bolt carriage 1 slides with the relative sloped plane H on the hammer 3 rotating it backwards while returning to the position B, (FIG. 13), after the firing of a round of ammunition. In the same FIG. 10 and more particularly in FIG. 11 the moment of the release of the automatic firing lever 14 is also shown, that is to say the moment in which such a lever disengages from the split 1*b* of the bolt carriage at 'Z ' when pushed by the automatic firing spring 15.

Figure 15:
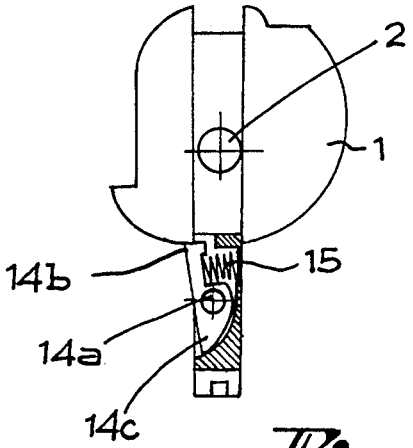
FIG. 15 is a view in the direction of the arrows XV–XV in FIG. 14.
Figure 14:
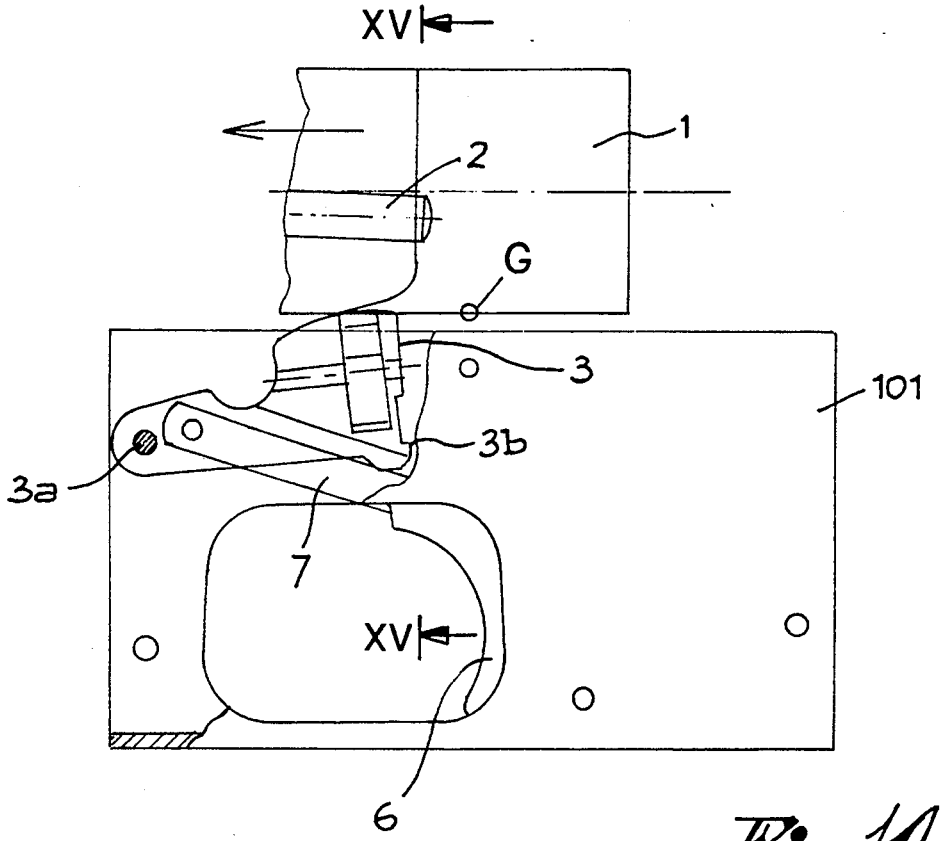
FIG. 14 shows the mechanism at the moment the automatic firing lever begins sliding on the bolt carriage.
Figure 16:
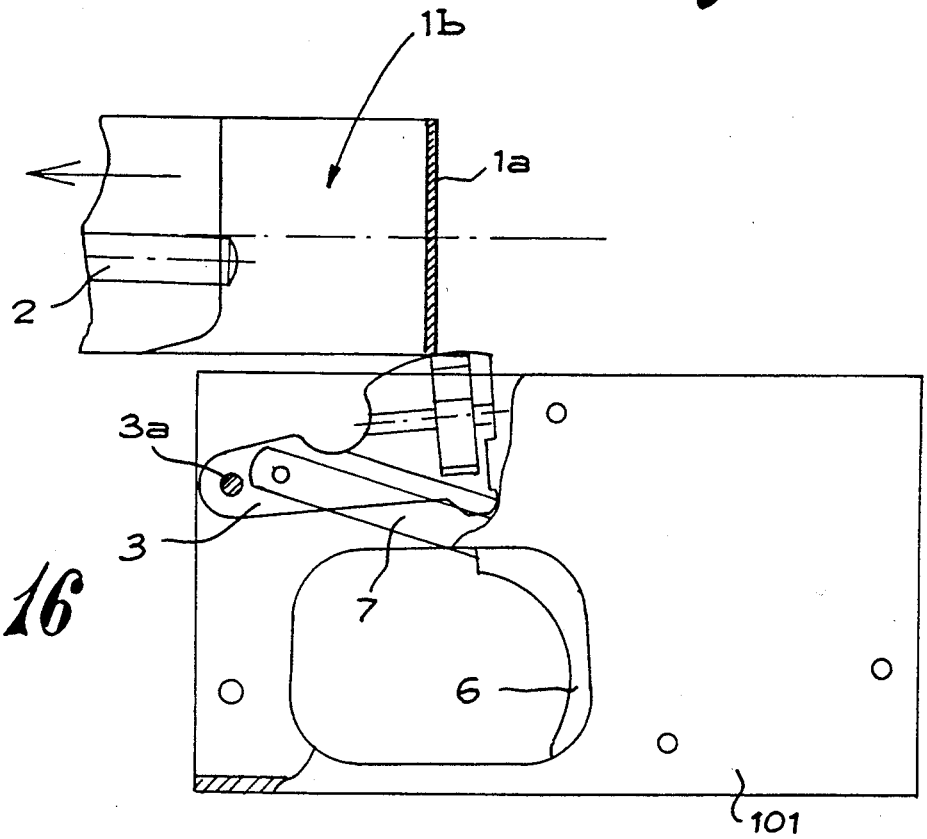
FIG. 16 is a similar view to the one in FIG. 13, but with bolt carriage as closed.

Thus, the head 14*b* of the automatic firing lever 14 protrudes from one side of the hammer 3, (FIG. 15) in order to interact with the lower blocking plane G of the bolt carriage on one side of the split 1*b*. This phase is also reproduced in FIG. 14 where the bolt carriage has already reversed direction in order to return towards the closed position. During its return to closure, the lower blocking plane G of the bolt carriage slides on the automatic firing lever thus keeping the hammer in an armed position until the bolt carriage is actually in the closed position A. Only at this point (FIGS. 16 and 17) does the automatic firing lever result as being disengaged from the plane G so the hammer can rotate towards the firing pin.

Following this rotation, the automatic firing lever 11 returns inside the profile of the hammer after coming into contact with the bevel 1*b*, as also occurs in single shot firing mode. This allows the hammer to go into the split 1*b* of the bolt carriage and to reach the firing pin.

This is so as long as the trigger remains operated, but as soon as the trigger is released, the sear returns to the intercepting and stopping position of the hammer thus interrupting the automatic firing mode.

Thus, the sear selects either single shot firing mode and automatic firing mode by either going closer to or moving further away from the hammer. The automatic firing lever on the side of the hammer helps to delay the percussion action of the hammer until the bolt carriage is securely closed.

While specific embodiments of the invention have been shown and described in detail to illustrate the application of the principles of the invention, it will be understood that the invention may be embodied otherwise without departing from such principles.

I claim:

1. A tripping mechanism for semiautomatic and automatic firearms, the mechanism comprising:

a trip box;

a bolt carriage positioned adjacent said trip box, said bolt carriage being movable between a forward position of closure/percussion of ammunition and a backward position of aperture/arming, said bolt carriage defining a split and having a blocking plane with a portion that is beveled toward said split, said bolt carriage including a firing pin positioned in said split;

a hammer rotatably attached at one end to said trip box and pivotable toward said firing pin into a percussion position and away from said firing pin into an armed position, said hammer including a hammer spring biasing said hammer toward said percussion position, and said bolt carriage pivoting said hammer away from said percussion position when said bolt carriage moves toward said backward position, said hammer being slidable into said split of said bolt carriage when said hammer pivots towards said percussion position;

an automatic firing lever in a recessed portion of said hammer, said automatic firing lever pivotably attached to said hammer and having a head pivotable between a first position and a second position, said first position of said head extending said head outward from said hammer and contacting said blocking plane of said bolt carriage during movement of said bolt carriage to said forward position in an automatic firing mode, said head contacting said blocking plane to stop entry of said hammer into said split during movement of said bolt carriage into said forward position, said bevel of said blocking plane being positioned to move said head into said second position when said bolt carriage is adjacent said forward position, said second position of said head causing said hammer to enter said split and move toward said firing pin;

an automatic firing spring biasing said head in said first position.

2. A mechanism in accordance with claim 1, further comprising:

a trigger pivotably connected to said trip box by a trigger pivot and movable between a rest position and a firing position, said trigger having a resting plane;

a sear having means for engaging said hammer in said armed position when in a single shot mode, said sear being positioned between said trigger pivot and said resting plane, and movable with said trigger when said trigger is pivoted, said sear is also slidable towards and away from said hammer along said resting plane, said sear sliding away from said hammer when said hammer moves into said armed position, said sear also balancing between said trigger pivot and said resting plane.

3. A mechanism in accordance with claim 2, further comprising:

a sear spring biasing said sear toward said hammer;

a trigger spring biasing said trigger toward said rest position.

4. A mechanism in accordance with claim 2, further comprising:

a rotating camshaft means for limiting movement of said trigger away from said rest position and selecting one of a safety mode, single shot mode and automatic mode.

5. A mechanism in accordance with claim 2, wherein: said resting plane is formed on said trigger spaced from said trigger pivot.

6. A mechanism in accordance with claim 1, wherein: said automatic firing lever includes a tail means for resting against said hammer and limiting a distance said head extends frown said hammer in said first position.

7. A tripping mechanism for semiautomatic and automatic firearms, the mechanism comprising:

a trip box;

a bolt carriage positioned adjacent said trip box, said bolt carriage being movable between a forward position of closure/percussion of ammunition and a backward position of aperture/arming, said bolt carriage defining a split and having a blocking plane with a portion that is beveled toward said split, said bolt carriage including a firing pin positioned in said split;

a hammer rotatably attached at one end to said trip box and pivotable toward said firing pin into a percussion position and away from said firing pin into an armed position, said hammer including a hammer spring biasing said hammer toward said percussion position, and said bolt carriage pivoting said hammer away from said percussion position when said bolt carriage moves toward said backward position, said hammer being slidable into said split of said bolt carriage when said hammer pivots towards said percussion position;

a trigger pivotably connected to said trip box by a trigger pivot and movable between a rest position and a firing position, said trigger having a resting plane;

a sear having means for engaging said hammer in said armed position when in a single shot mode, said sear being positioned between said trigger pivot and said resting plane, and movable with said trigger when said trigger is pivoted, said sear is also slidable towards and away from said hammer along said resting plane, said sear sliding away from said hammer when said hammer moves into said armed position, said sear also balancing between said trigger pivot and said resting plane, said sear defining a sear split and said trigger pivot being positioned inside said sear split, said sear split has first and second sides to contact said trigger pivot and limit sliding towards and away from said hammer, said split also having a bottom side including a step with first and second levels, said first and second levels interact with said trigger pivot to cause balancing of said sear during sliding of said sear and during movement of said hammer into said armed position;

a sear spring biasing said sear toward said hammer;

a trigger spring biasing said trigger toward said rest position.

* * * * *